US006771792B1

(12) United States Patent
Shirakawa

(10) Patent No.: US 6,771,792 B1
(45) Date of Patent: Aug. 3, 2004

(54) TRACK-SHAPED LOUDSPEAKER

(75) Inventor: Hidetoshi Shirakawa, Akishima (JP)

(73) Assignee: Foster Electric Co., Ltd., Tokyo (JP)

( * ) Notice: Subject to any disclaimer, the term of this patent is extended or adjusted under 35 U.S.C. 154(b) by 288 days.

(21) Appl. No.: 09/466,322

(22) Filed: Dec. 17, 1999

(30) Foreign Application Priority Data

Dec. 28, 1998 (JP) ..... 10-373371
Mar. 8, 1999 (JP) ..... 11/59610

(51) Int. Cl.[7] ..... H04R 25/00
(52) U.S. Cl. ..... 381/412; 381/423; 381/419
(58) Field of Search ..... 381/396, 398, 381/412, 420, 421, 422, 423, 431, 432, FOR 153, FOR 162; 181/171, 172

(56) References Cited

U.S. PATENT DOCUMENTS 5,319,718 A * 6/1994 Yocum ..... 381/398
5,574,797 A * 11/1996 Geisenberger ..... 381/432
5,740,264 A * 4/1998 Kojima ..... 381/398

FOREIGN PATENT DOCUMENTS

| | | |
|---|---|---|
| EP | 0 680 242 A1 | 11/1995 |
| GB | 2 127 650 A | 4/1984 |
| JP | 62-143398 | 9/1987 |

* cited by examiner

*Primary Examiner*—Sinh Tran
(74) *Attorney, Agent, or Firm*—Lynn & Lynn

(57) ABSTRACT

An elongated oval track-shaped loudspeaker has a diaphragm of a track-shape having major and minor axes, and a pole piece of an elongated oval shape and disposed to conform its major axis to that of the diaphragm, whereby a sufficient space is secured for a width size of a diaphragm-supporting damper at its portions on both sides along the major axis of the diaphragm, a magnet around the pole piece is enlarged, and the pole piece is dimensioned in its sectional area to correspond to the magnet to cause no magnetic saturation.

1 Claim, 2 Drawing Sheets

TRACK-SHAPED LOUDSPEAKER

BACKGROUND OF THE INVENTION

This invention relates to loudspeakers incorporated in, for example, televisions or the like and, in particular, to an elongated oval, track-shaped loudspeakers.

DESCRIPTION OF RELATED ART

While the televisions or the like devices incorporate therein the loudspeakers, slimmed exterior design of the televisions has been overwhelming, and consequently the loudspeakers to be incorporated in the televisions have been also adapted in various ways to be elongated oval to be such as an athletic race-track shape which is mountable in narrow restricted zone due to a demand of space factor.

In conventional loudspeakers of this kind, for example, a pole piece and a magnet constituting magnetic circuit are formed in the form of a thin plate, and the pole piece is formed to be circular in section, while the magnet substantially rectangular in the exterior shape is disposed, in the concrete, on a yoke of the magnetic circuit, a plate is provided on the magnet, and a voice coil wound on a voice coil bobbin is disposed in a magnetic gap defined between the plate and the pole piece. A damper is coupled at its inner periphery to outer periphery of the voice coil bobbin, and at outer periphery to an inner wall of a frame of the loudspeaker.

In order to increase the magnetic flux density at the magnetic gap in such loudspeaker, it is necessary to form the magnet as large as possible in allowable extent of exterior of the loudspeaker, whereas a magnetic saturation is caused to occur when the pole piece is still small in its cross sectional area relative to the magnet made larger, and it is impossible to increase the magnetic flux only by means of the enlargement of the magnet.

More specifically, the magnetic saturation occurs to deteriorate the magnetic efficiency even when the exterior size of the magnet is made as large as possible to the allowable extent of the shape of the loudspeaker frame, so long as the cross sectional area of the pole piece is equivalent to a surface area of a circle having a diameter more than ½.9 in particular of the minor axis side dimension of the loudspeaker, that is, so long as the cross sectional area of the pole is made to be substantially more than ⅓ with respect to the minor axis side dimension of the loudspeaker, due to the relationship between the magnetic flux density and the permeability of a carbon steel forming the yoke.

When on the other hand the diameter of the pole piece is made larger in order to increase the cross sectional area, the width between both side walls along the major axis of the loudspeaker of elongated shape and outer peripheral walls of the voice coil bobbin opposing both side walls is made narrower, and the damper supporting the bobbin is also caused to be narrower necessarily at the particular position. As the damper becomes narrower, there arises such problems that the damper lowers the compliance to reduce the amplitude, and the loudspeaker is deteriorated in the bass range characteristics and in the tone quality.

As an example of prior art improved in the above respects, a loudspeaker of such arrangement as disclosed in Japanese Utility Model Laid-Open Publication No. 62-143398 has been suggested.

In this known loudspeaker, the pole piece and voice coil are formed to be oblong or elliptic to be elongated in the direction of the major axis of the loudspeaker, so that a certain width of space can be secured between both side walls along the major axis of the loudspeaker and the outer peripheral walls of the voice coil bobbin opposing the edges, a good width can be secured for the damper at its portions disposed in said both side spaces, and a desired tone quality can be attained.

According to the above publication No. 62-143398, however, it is realizable to simply secure the width on both sides along the major axis of the loudspeaker by means of the oblong or elliptic shape of the pole piece, but it is still impossible to provide a technique of attaining the optimum magnetic efficiency.

SUMMARY OF THE INVENTION

The present invention has been suggested to overcome the foregoing problems, and its object is to provide a track-shaped loudspeaker capable of securing an enough width of damper portions disposed between both side walls along the major axis of the loudspeaker and opposing outer peripheral walls of voice coil bobbin, for rendering the resonance frequency to be in lower range and for improving the magnetic efficiency.

According to the present invention, the above object can be realized by means of an elongated oval, track-shaped loudspeaker wherein a voice coil wound on a bobbin is disposed in a magnetic gap between a pole piece and a plate on a magnet disposed around the pole piece, an elongated oval track-shaped diaphragm is joined to the voice coil bobbin supported through a damper to a frame, the pole piece is track-shaped to elongate along major axis of the track-shaped diaphragm, the voice coil bobbin in the gap as well as the magnet disposed around the pole piece are track-shaped, the damper supporting the voice coil bobbin is track-shaped at inner and outer peripheries, and a cross sectional area of the track-shaped pole piece is made to be equal to that of a circle of a diameter more than ⅓ of a minor axis side length of the loudspeaker, so that no magnetic saturation will occur even with the magnet made larger and a magnetic efficiency can be elevated. The magnetic efficiency is improved by providing to the pole piece a circular cross sectional area of the diameter substantially more than ⅓ of the minor axis side length a, as will be readily appreciated from the view point of magnetic properties of the yoke member (carbon steel, SIOC or the like) employed.

Other objects and advantages of the present invention shall become clear as the following description of the invention advances as detailed with references to certain preferred embodiments shown in accompanying drawings.

Figure 1:
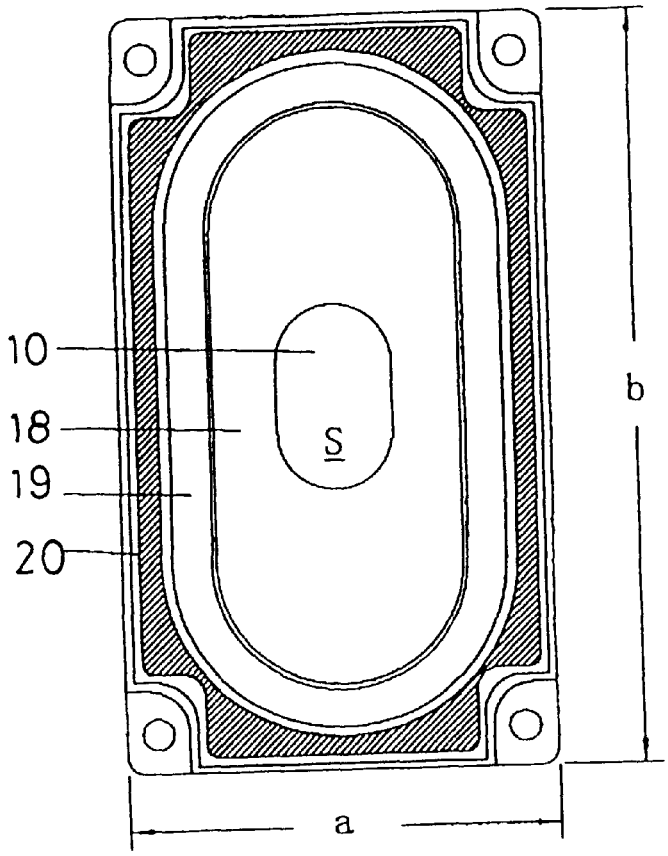
FIG. 1 is a plan view of a track-shaped loudspeaker in an embodiment according to the present invention.

While the present invention shall now be described with reference to the respective embodiments shown in the drawings, it should be appreciated that the intention is not to limit the invention only to these embodiments shown but to include all alterations, modifications and equivalent arrangements possible within the scope of appended claims.

DETAILED DESCRIPTION OF THE PREFERRED EMBODIMENTS

Figure 2:
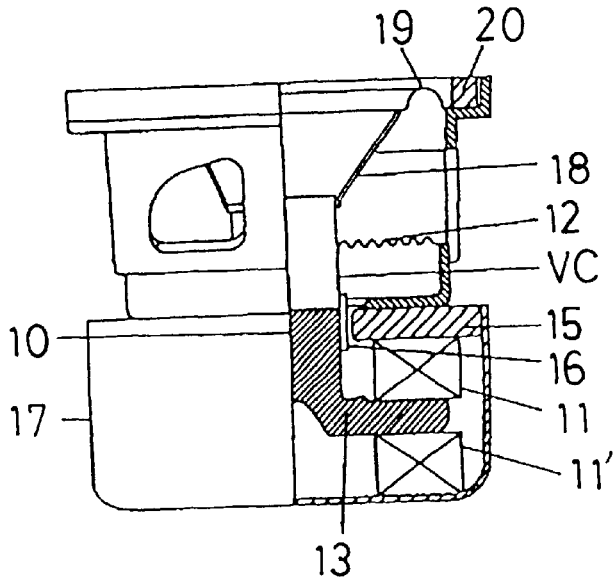
FIG. 2 is an endwise side view of the loudspeaker in FIG. 1 with part shown in section.

Referring to FIGS. 1 and 2, the shape of the pole piece is elongated so as not to reduce the width of damper at its portions between the pole piece and both elongated side walls of the loudspeaker and, at the same time, a large cross sectional area of the pole piece enough for causing no magnetic saturation is secured. In this event, the sufficient width of the damper is secured without deteriorating the magnetic efficiency, whereby the compliance of the damper and eventually of the diaphragm can be elevated and it is enabled to attain a required amplitude of the damper and diaphragm.

Further, the structure of the track-shaped loudspeaker of the present invention shall be described in the concrete.

Referring again to FIGS. 1 and 2, a loudspeaker frame employed in the present invention is made, in the entire plan view, to be of an elongated rectangular shape at a ratio of a minor axis side length a to a major axis side length b of 1:1.75 or more. This is because available spaces within the televisions for mounting the loudspeakers to be incorporated therein are generally in this range of dimensional ratio, and it is optimum to prepare the loudspeakers at this dimensional ratio.

In the present invention, a magnet 11 disposed around a pole piece 10 is formed to be as large as possible in allowable range with respect to the exterior of the loudspeaker in order to increase the magnetic flux density, and the pole piece 10 forming the magnetic circuit together with a base plate 13 is formed in an elongated oval track shape. A voice coil bobbin VC disposed around the pole piece 10 with a fine gap left is also formed in the track shape in correspondence to the pole piece 10, and the damper 12 is also formed in the similar track shape in respect of the inner and outer peripheries.

While, in the illustrated embodiment, it has been able to obtain an extremely excellent result by setting the minor axis side length a to be 44 mm and the major axis side length b to be 82.0 mm, it is possible to set the dimension at a different ratio, and the rectangular shape may even be more elongated to be slender.

With the use of the elongated track shape for the respective members in the present invention, it is attempted to secure side spaces of a sufficient width between the major axis side walls of the loudspeaker and the outer periphery of the voice coil bobbin VC carrying the voice coil 16 disposed around the pole piece 10, so that the width of the damper 12 at its portions disposed in the side spaces can be kept not to become narrower, and thus the damper 12 can be prevented from being deteriorated in the compliance, so as not to reduce the amplitude.

When in this case the pole piece 10 is of a small cross sectional area S even the sufficient width is secured between the major axis side walls of the loudspeaker and the pole piece 10, there is caused the magnetic saturation to occur even with the diameter of the pole piece 10 made as large as possible to the allowable extent inside the loudspeaker, and the magnetic efficiency cannot be improved.

When, in the present invention, the pole piece is made in a circular shape in its section, the cross sectional area S of the pole piece 10 is made to be equal to a circle of a diameter more than ⅓ with respect to the minor axis side length a, so that no magnetic saturation will occur even with the magnet 11 made larger and the magnetic efficiency can be elevated. The magnetic efficiency is improved by providing to the pole piece a circular cross sectional area of the diameter substantially more than ⅓ of the minor axis side length a, as will be readily appreciated from the view point of magnetic properties of the yoke member (carbon steel, SIOC or the like) employed.

In the present embodiment of FIGS. 1 and 2, further, an additional magnet 11' is disposed below the magnet 11 to thus hold the base plate 13 between these magnets 11 and 11', and a magnetic plate 15 is disposed on the magnet 11, an inner periphery of which plate 15 is opposed to the outer periphery of the pole piece 10 to define a magnetic gap between them, and the voice coil 16 on the bobbin VC disposed in the magnetic gap. A lower half, up to the outer periphery of the plate 15, of the loudspeaker including the magnetic circuit is covered with a shield case 17 acting as the yoke, a diaphragm 18 track-shaped at both of inner and outer peripheries is disposed as joined at the inner periphery to the outer periphery at top end part of the bobbin VC and at the outer periphery to an edge 19 also track-shaped, and an outer periphery of the edge 19 is secured to a top end of a rectangular frame of the loudspeaker by means of a gasket 20.

In the foregoing embodiment according to the present invention, there is secured a sufficient width for both side portions on the major axis side of the damper 12, at both side spaces between the major axis side walls of the frame and the opposing outer peripheral walls of the track-shaped voice coil bobbin VC, whereby the compliance of the damper and eventually of the diaphragm can be elevated to attain a required amplitude and the tone quality of the loudspeaker can be improved, as will be readily appreciated.

Figure 3:
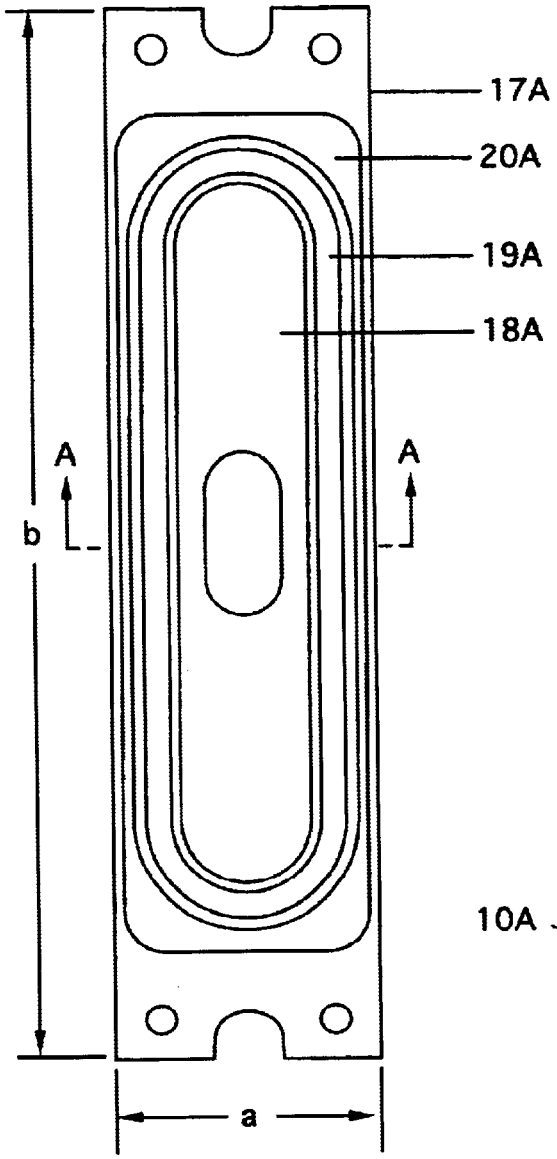
FIG. 3 is a plan view of the track-shaped loudspeaker in another embodiment according to the present invention.
Figure 4:
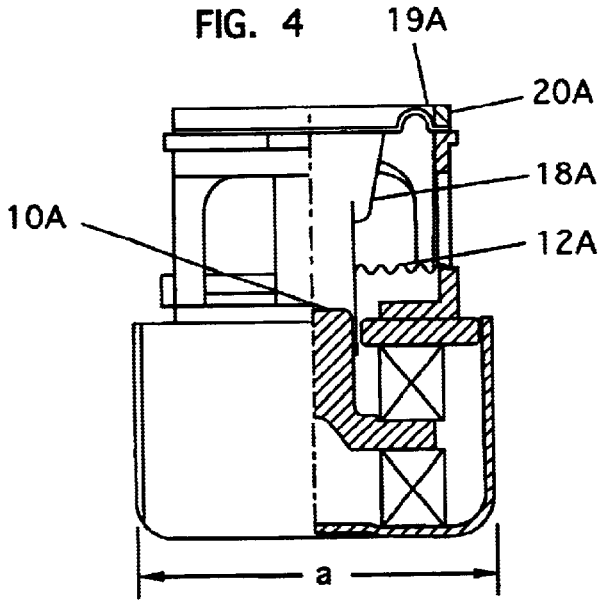
FIG. 4 is an endwise side view of the loudspeaker in FIG. 3 with part shown in section.

Next, another embodiment of the present invention as shown in FIGS. 3 and 4 shall be described.

When the compliance of the diaphragm edge in addition to that of the damper is low, in general, it becomes difficult to shift the resonance frequency of to a lower range. In the present embodiment, therefore, an edge 19A made of a foam rubber is employed for securing the outer periphery of the diaphragm 18A, in addition to the formation of the damper 12A in the track shape at both of the inner and outer peripheries to ensure the sufficient width, so that the compliance of both of the edge 19A and diaphragm 18A can be optimumly improved.

In the present embodiment, further, the entire rectangular shape of the loudspeaker as well as the track shape of other constituents are further elongated than in the foregoing embodiment. That is, the entire rectangular shape is made to be at a dimensional ratio of more than 1:1.75 of the minor axis side length a to the major axis side length b. To be more concrete, for example, the rectangular shape is formed with the minor axis side length a of 35.1 mm and the major axis side length b of 123.5 mm.

Other respects of the present embodiment are the same as those in the foregoing embodiment, as shown in FIGS. 1 and 2.

For the foam rubber of the edge 19A, vulcanized rubber, thermoplastic elastomer or the like may be employed, while the vulcanized rubber is a proper one selected from the group consisting of styrene-butadiene rubber, nytril-butadiene rubber, ethylene-propylene terpolymer rubber, isoprene rubber, chloroprene rubber, isobutylene-isoprene rubber, ethylenepropylene rubber, silicone rubber and the like.

Further, the thermoplastic elastomer is one selected from the group consisting of polystyrenes, polyolefins, polyurethanes, polyesters, polyamides, polybutadienes, ethylene-vinyl acetates, polyvinyl chlorides and the like.

For a foaming agent employed in preparing the edge material, one of a type of gas evolution due to pyrolysis and of a specific gravity in a range of 0.07 to 1.2 should preferably be used.

Further, the edge 19A of the foam rubber should preferably be integralized with the outer peripheral part of the diaphragm 18A simultaneously with the molding at least of the edge.

What is claimed is:

1. An elongated oval track-shaped loudspeaker wherein a voice coil wound on a bobbin is disposed in a magnetic gap between a pole piece and a plate on a magnet disposed around the pole piece, an elongated oval track-shaped diaphragm is joined to the voice coil bobbin supported through a damper to a frame, the pole piece is track-shaped to elongate along major axis of the track-shaped diaphragm, the voice coil bobbin in the gap as well as the magnet disposed around the pole piece are track-shaped, the damper supporting the voice coil bobbin is track-shaped at inner and outer peripheries, and a cross sectional area of the track-shaped pole piece is made to be equal to that of a circle of a diameter more than ⅓ of a minor axis side length of the loudspeaker so that no magnetic saturation will occur even with the magnet made larger and a magnetic efficiency can be elevated.

* * * * *